US006427674B1

(12) United States Patent
Wylin

(10) Patent No.: US 6,427,674 B1
(45) Date of Patent: Aug. 6, 2002

(54) SOCKET COIL-ON-PLUG RETAINER

(75) Inventor: James P Wylin, Waterford, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 09/963,084

(22) Filed: Sep. 24, 2001

(51) Int. Cl.[7] ..... F02P 11/00
(52) U.S. Cl. ..... 123/634; 123/635
(58) Field of Search ..... 123/634, 635, 123/637, 594

(56) References Cited

U.S. PATENT DOCUMENTS 4,172,439 A * 10/1979 Pasbrig ..... 123/148 E
4,300,519 A * 11/1981 Isogai et al. ..... 123/647
4,846,129 A 7/1989 Noble
5,377,652 A 1/1995 Noble et al.
5,406,921 A 4/1995 Noble et al.
5,408,870 A 4/1995 Noble et al.
5,411,006 A 5/1995 Noble et al.
5,526,788 A 6/1996 Noble et al.
5,534,781 A 7/1996 Lee et al.
5,618,193 A 4/1997 Nakajima et al.
5,682,865 A * 11/1997 Maekawa et al. ..... 123/635
5,692,484 A 12/1997 Downey
5,706,792 A 1/1998 Boyer et al.
5,767,758 A 6/1998 Sakamaki
5,842,456 A 12/1998 Morganti
5,944,002 A 8/1999 Tracy et al.

* cited by examiner

*Primary Examiner*—Bibhu Mohanty
(74) *Attorney, Agent, or Firm*—Ralph E. Smith

(57) ABSTRACT

A coil-on-plug ignition system for mounting an ignition coil to a valve cover of a vehicle. The coil-on-plug ignition system includes an ignition coil having a connecting terminal connectable to a spark plug of the vehicle. The system further includes a retaining clip fixedly mounted to the ignition coil. The retaining clip has a mounting portion that includes a slot. The slot is adapted to receive a pin extending from the valve cover for selectively retaining the ignition coil to the valve cover through a twisting connection. A biasing member is further included for biasing the retaining clip in a retaining position. The biasing member is mounted between the retaining clip and the valve cover.

14 Claims, 1 Drawing Sheet

SOCKET COIL-ON-PLUG RETAINER

FIELD OF THE INVENTION

The present invention generally relates to engine ignition systems and, more particularly, relates to a structure for connecting an ignition coil to a spark plug for use in a coil-on-plug ignition system.

BACKGROUND OF THE INVENTION

Many modern internal combustion engines incorporate an ignition system that is typically described as a coil-on-plug or COP ignition system. A coil-on-plug ignition system, as well known to those skilled in the art, includes an ignition coil, a valve cover, and a spark plug adapter tube that connects with a spark plug. Each individual cylinder of the internal combustion engine includes a separate spark plug, spark plug adapter tube, and ignition coil.

Typically, the ignition coil and spark plug adapter tube are connected to each spark plug and fastened to the valve cover via a plurality of fasteners. As can be appreciated, in order to properly receive the plurality of fasteners, the valve cover must include a plurality of corresponding threaded inserts. Typically, it is necessary to machine each valve cover to readily accept these threaded inserts and fasteners. As will be understood by those skilled in the art, such machining of the valve cover requires enormous amounts of time and labor, which correspond to increased production costs.

Accordingly, there exists a need in the relative art to provide a coil-on-plug retainer that overcomes the disadvantages of the prior art. Furthermore, there exists a need in the relevant art to provide a coil-on-plug retainer that may be selectively secured to the valve cover without the need to first machine the valve cover to receive various fasteners. Still further, there exists a need in the relevant art to provide a coil-on-plug retainer that is secured on a valve cover of the engine through a socketing interface to provide a simple and cost effective method of coupling.

SUMMARY OF THE INVENTION

In accordance with the broad teachings of this invention, a coil-on-plug ignition system having an advantageous construction is provided. The coil-on-plug ignition system is adapted for mounting an ignition coil to a valve cover of a vehicle. The coil-on-plug ignition system includes an ignition coil having a connecting terminal connectable to a spark plug of the vehicle. The system further includes a retaining clip fixedly mounted to the ignition coil. The retaining clip has a mounting portion that includes a slot. The slot is adapted to receive a pin extending from the valve cover for selectively retaining the ignition coil to the valve cover through a twisting connection. A biasing member is further mounted between the retaining clip and the valve cover for biasing the retaining clip in a retaining position.

Further areas of applicability of the present invention will become apparent from the detailed description provided hereinafter. It should be understood that the detailed description and specific examples, while indicating preferred embodiments of the invention, are intended for purposes of illustration only.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
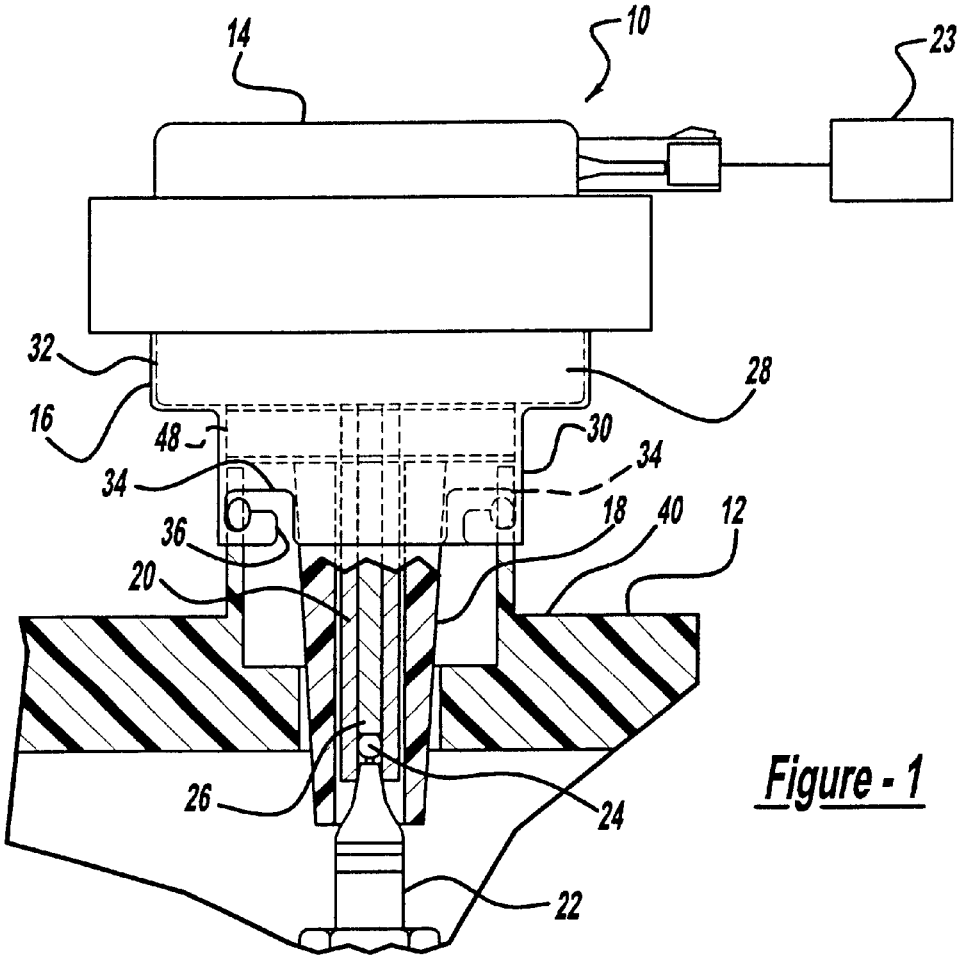
FIG. 1 is a side view, with portions in cross-section, illustrating the socket coil-on-plug retainer of the present invention mounted to a valve cover of an internal combustion engine.

The following description of the preferred embodiment is merely exemplary in nature and is in no way intended to limit the invention, its application, or uses.

Referring to the drawings, a socket coil-on-plug retainer assembly 10 is shown having a valve cover 12, an ignition coil 14, a coil retaining clip 16, a spark plug boot 18, and a spark plug adapter tube 20. Socket coil-on-plug retainer assembly 10 is adapted to electrically couple a spark plug 22 to an ignition system 23 of the vehicle. The operational principles of a coil-on-plug ignition system are well known in the art and, thus, in the interest of brevity, will not be discussed in detail herein.

A terminal portion 24 of spark plug 22 is electrically coupled to a connecting terminal 26 of ignition coil 14 through spark plug adapter tube 20. Spark plug adapter tube 20 generally surrounds connecting terminal 26 and is preferably made of an insulating material. This insulating material preferably electrically insulates connecting terminal 26 to provide a reliable electrical connection with spark plug 22. Spark plug adapter tube 20 is preferably sufficiently sized to provide a snap fit with terminal portion 24 of spark plug 22.

Figure 2:
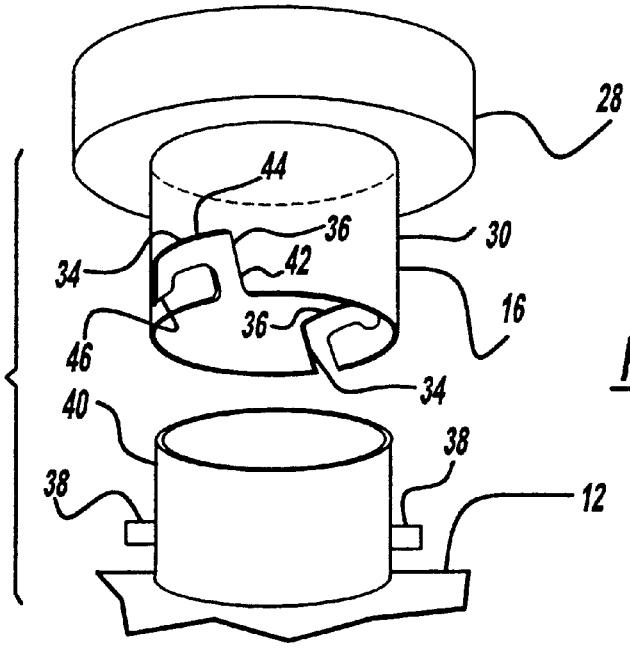
FIG. 2 is a simplified exploded perspective view illustrating the coil retaining clip and valve cover of the present invention with the remaining elements removed for clarity.

Referring to FIGS. 1 and 2, coil retaining clip 16 includes a major portion 28 and a minor portion 30. In the illustrated embodiment, major portion 28 is generally cylindrical in shape which is sized to cooperate with and be mounted to a mounting flange 32 (FIG. 1) of ignition coil 14. Major portion 28 of coil retaining clip 16 may be secured to mounting flange 32 of ignition coil 14 via any known method, such as fasteners, adhesives, and the like.

Alternatively, coil retaining clip 16 may be formed integrally with the housing of ignition coil 14 to create a single ignition coil unit. It should be understood that a separate coil retaining clip 16 enables existing ignition coil designs to be retrofitted so as to be used with the socket coil-on-plug retaining assembly of the present invention. However, integral molding of coil retaining clip 16 with ignition coil 14 provides additional advantages. That is, such integrally manufactured designs permit the reduction of the number of parts required and the associated labor required for assembly and, thus, reduces the manufacturing cost of the assembly.

Minor portion 30 of coil retaining clip 16 is preferably cylindrical in shape so as to facilitate installation of coil retaining clip 16 onto valve cover 12, as will be described in detail below. However, it should be appreciated that minor portion 30 of coil retaining clip 16 may be of any shape conducive to the mounting of ignition coil 14 on valve cover 12. Other shapes, such as those including a physical stop, may be conducive to facilitating proper installation of socket coil-on-plug retainer assembly 10.

In the preferred embodiment, minor portion 30 of coil retaining clip 16 includes a pair of fastening slots 34 formed therein. In the illustrated embodiment, each of the fastening slots 34 include a generally inverted-J slot 36 sized to receive a corresponding coil retaining post 38 extending outwardly from valve cover 12. Specifically, coil retaining posts 38 are generally cylindrical and extend orthogonally from a spark plug cavity sidewall 40 of valve cover 12.

Preferably, coil retaining posts 38 are each formed integral with valve cover 12; however, coil retaining posts 38 may be installed as separate dowel type members following forming of valve cover 12. Inverted-J slots 36 each include an entry path 42, a transition path 44, and a retaining depression 46.

During installation of ignition coil 14, coil retaining clip 16 is inserted over spark plug cavity sidewall 40 such that coil retaining posts 38 slide within entry path 42 of corresponding inverted-J slot 36. Once coil retaining clip 16 is fully inserted over spark plug cavity sidewall 40, ignition coil 14 and, consequently, coil retaining clip16 are rotated or twisted in a counter-clockwise direction such that coil retaining posts 38 slide within transition path 44. This sliding motion is continued until coil retaining posts 38 rest within retaining depressions 46 to effect a secured and locked condition between ignition coil 14 and valve cover 12.

Spark plug boot 18 is preferably made of a resilient material, such as rubber, to provide a biasing force to retain coil retaining posts 38 within retaining depressions 46. Specifically, spark plug boot 18 includes a top portion 48 and an elongated portion 50 extending from top portion 48. Top portion 48 is generally circular in shape and is disposed within minor portion 30 of coil retaining clip 16. As best seen in FIG. 1, top portion 48 of spark plug boot 18 is positioned adjacent to a lower end of ignition coil 14. Top portion 48 is sized to be generally greater than a distance between the lower end of ignition coil 14 and a top end of spark plug cavity sidewall 40. Therefore, when coil-on-plug retainer assembly 10 is installed on valve cover 12, top portion 48 of spark plug boot 18 is wedged between ignition coil 14 and spark plug cavity sidewall 40 to provide a biasing force to retain coil retaining posts 38 within retaining depressions 46 and, further, to provide a seal to minimize dirt, debris, and/or water from entering the spark plug cavity. Elongated portion 50 of spark plug boot 18 further provides a seal about spark plug adapter tube 20 and the electrical connection between connecting terminal 26 and spark plug 22.

Coil-on-plug retainer assembly 10 of the present invention provides a number of advantages of the prior art. For example, coil-on-plug retainer assembly 10 of the present invention eliminates the need for complex machining of the valve cover. Furthermore, coil-on-plug retainer assembly 10 of the present invention eliminates the use of a plurality of fasteners retaining the ignition coil to the valve cover. Still further, coil-on-plug retainer assembly 10 of the present invention eliminates the labor and associated cost of torqueing each of the plurality of fasteners, since the present invention employs a reliable push, turn, and lock method of fastening. Coil-on-plug retainer assembly 10 of the present invention further eliminates the need to stock and supply such a large number of now superfluous parts.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A coil-on-plug ignition system for mounting to a valve cover of a vehicle, said coil-on-plug ignition system comprising:

an ignition coil having a connecting terminal connectable to a spark plug of the vehicle;

a retaining clip fixedly mounted to said ignition coil, said retaining clip having a mounting portion, said mounting portion including a slot capable of receiving a pin extending from the valve cover for selectively retaining said ignition coil to the valve cover; and a biasing member biasing said retaining clip, said biasing member adapted to be mounted between said retaining clip and the valve cover.

2. The coil-on-plug ignition system according to claim 1 wherein said retaining clip is integrally formed with said ignition coil.

3. The coil-on-plug ignition system according to claim 1 wherein said biasing member comprises:

a top portion adapted to be mounted between said retaining clip and the valve cover; and an elongated portion integrally formed with said top portion, said elongated portion generally surrounding said connecting terminal of said ignition coil.

4. The coil-on-plug ignition system according to claim 1 wherein said biasing member fluidly seals said ignition coil.

5. The coil-on-plug ignition system according to claim 1 wherein said slot is an inverted J-slot.

6. A vehicle comprising:

a valve cover having a sidewall;

a mounting post extending orthogonally from said sidewall of said valve cover;

an ignition coil having a connecting terminal connectable to a spark plug of the vehicle;

a retaining clip fixedly mounted to said ignition coil, said retaining clip having a mounting portion, said mounting portion including a slot, said slot sufficiently sized to receive said mounting post therein for selectively retaining said ignition coil to said valve cover; and a biasing member biasing said retaining clip, said biasing member being disposed between said retaining clip and said valve cover.

7. The vehicle according to claim 6 wherein said retaining clip is integrally formed with said ignition coil.

8. The vehicle according to claim 6 wherein said biasing member comprises:

a top portion disposed between said retaining clip and said valve cover; and an elongated portion integrally formed with said top portion, said elongated portion generally surrounding said connecting terminal of said ignition coil.

9. The vehicle according to claim 6 wherein said biasing member fluidly sealing between said ignition coil and said valve cover.

10. The vehicle according to claim 6 wherein said slot is an inverted J-slot.

11. A vehicle comprising:

a valve cover having a sidewall;

at least a pair of mounting posts extending from said sidewall of said valve cover;

an ignition coil having a connecting terminal connectable to a spark plug of the vehicle;

a retaining clip coupled to said ignition coil, said retaining clip having at least a pair of inverted-J slots, each of said at least a pair of inverted-J slots being sized to receive a corresponding one of said at least a pair of mounting posts therein for selectively retaining said ignition coil to said valve cover; and a biasing member biasing said retaining clip, said biasing member being disposed between said retaining clip and said valve cover.

12. The vehicle according to claim 11 wherein said retaining clip is integrally formed with said ignition coil.

13. The vehicle according to claim 11 wherein said biasing member comprises:

a top portion disposed between said retaining clip and said valve cover; and an elongated portion integrally formed with said top portion, said elongated portion generally surrounding said connecting terminal of said ignition coil.

14. The vehicle according to claim 11 wherein said biasing member fluidly sealing between said ignition coil and said valve cover.

* * * * *